United States Patent [19]

Boulanger et al.

[11] 4,317,100

[45] Feb. 23, 1982

[54] READILY MOUNTABLE THERMOSTAT

[75] Inventors: Henry J. Boulanger, Cumberland; Philip R. Gouin, Manville, both of R.I.

[73] Assignee: Texas Instruments Incorporated, Dallas, Tex.

[21] Appl. No.: 201,939

[22] Filed: Oct. 29, 1980

[51] Int. Cl.[3] ..... H01H 37/12

[52] U.S. Cl. ..... 337/347; 337/374

[58] Field of Search ..... 337/343, 347, 348, 349, 337/354, 374, 375

[56] References Cited

U.S. PATENT DOCUMENTS

| | | | |
|---|---|---|---|
| 2,824,194 | 2/1958 | Moorhead | 337/354 X |
| 3,164,701 | 1/1965 | Kirchhubel | 337/347 X |
| 3,768,057 | 10/1973 | Sekira et al. | 337/354 X |
| 3,913,053 | 10/1975 | Place | 337/347 |

*Primary Examiner*—George Harris

*Attorney, Agent, or Firm*—James P. McAndrews; John A. Haug; Melvin Sharp

[57] ABSTRACT

A thermostat device has control means movable between control positions on a base when a thermostat metal element moves with snap action in response to temperature changes. Angle-shaped mounting brackets of a relatively high strength metal material have respective legs fitted against a boss on the base periphery and a cup-shaped cap of a relatively more formable and more thermally conductive metal is fitted over the thermostat metal element on the base to enclose the noted legs of the brackets. Portions of the cup are deformed into openings in the enclosed bracket legs to draw the brackets firmly against the boss for securing the cap, brackets and thermostat metal element to the base, for conveniently and accurately locating the thermostat metal element in a desired control location on the base, and for permitting use of the brackets in mounting the thermostat device and use of the thermally conducting cap in transmitting heat to the thermostat metal element while reliably maintaining the control location of the element.

7 Claims, 5 Drawing Figures

READILY MOUNTABLE THERMOSTAT

BACKGROUND OF THE INVENTION

The field of this invention is that of thermostats and the invention relates more particularly to a thermally responsive control adapted to be mounted on an apparatus whose temperature is to be monitored for moving control means between control positions in response to selected temperature changes.

Conventional thermostats which are widely used on many different kinds of apparatus typically comprise an electrical switch mounted on one end of a generally cylindrical, electrically insulating base to be moved between positions opening and closing an electrical circuit. A dished thermally responsive snap acting thermostat metal element is positioned in a control location at the opposite end of the insulating base so that it moves from an original dished configuration to an inverted dished configuration with snap action in response to selected temperature changes. A motion transfer pin is axially slidable on the base between the thermostat metal element and the switch for moving the switch between the noted control positions in response to snap-acting movement of the element. In such conventional devices, a cup-shaped metal cap is typically deep-drawn from a relatively strong and rigid metal material such as stainless steel and is provided with an apertured flange extending outwardly from the rim of the cap. The cupped part of the cup is fitted over the opposite end of the cylindrical base part and is deformed or indented so that it grips bosses formed on the outer periphery of the base, thereby to secure the snap acting thermostat metal element in the desired control location on the device base. In that arrangement, the flanges of the cup are used for mounting the device on an object or apparatus whose temperatue is to be monitored and serve to position the snap acting thermostat metal element in close heat-transfer relation to the object for sensing changes in object temperature through the metal cap.

Conventional thermostats of that construction have found wide application both because of their low cost and because of their reliability in use. In that regard, the thermostat structure is adapted to be reliably and accurately assembled to precisely position the snap acting thermostat metal element so that it provides its desired control functions at precisely predetermined temperatures. However, it would be desirable to provide further improvements in the structure of the thermostat to permit additional component and assembly cost savings, particularly if such cost improvements could be accomplished while improving thermostat performance and reliability. In that regard, it has been found that the deep-drawn cap tends to be quite expensive when formed of a high strength material such as stainless steel to permit the cap flange to be used in mounting the thermostat. When the cap is made of stainless steel it also displays thermal conductivity which may limit the thermal response characteristics of the thermostat. Most important, where the cap is deformed to directly engage boss means on the electrically insulating base for locating the thermostat metal element, thermal cycling of the device may limit service life by permitting ultimate loosening of the cap with resulting change in the thermal response characteristics of the device.

It is an object of this invention to provide a novel and improved thermally responsive control device; to provide such an improved control device with a rugged reliable construction adapted for widespread application; and to provide such a device which is characterized by relatively lower component cost, by improved assembly cost, by improved reliability in use, and by improved response to changes in temperature of an object whose temperature is to be monitored.

BRIEF SUMMARY OF THE INVENTION

Briefly described, the thermostat of this invention has a control means such as an electrical switch mounted on one end of a generally cylindrical, electrically insulating base. A dished, thermally responsive snap-acting thermostat metal element is positioned in a control location at the opposite end of the insulating base and a motion transfer pin is axially slidable on the base between the element and the switch. The thermostat metal element is movable from an original dished configuration to an inverted dished configuration in response to selected temperature changes and the pin is arranged to transfer such movement to the switch or other control means for moving the control means between control positions as the temperature changes occur.

In accordance with this invention, the base is provided with a shoulder or other reference surface facing outwardly from the opposite end of the insulating base and boss means are provided on the outer periphery of the base to provide a locating surface adjacent the opposite base end which faces away from the opposite base end. A pair of angle-shaped mounting brackets are formed of a relatively strong and rigid metal such as plated or galvanized low carbon steel and a first leg of each bracket is fitted against the outer periphery of the base so that the end of the bracket leg fits against the locating surface on the boss on the base periphery. The other leg of each bracket is arranged to extend laterally away from the base. A cup-shaped cap is formed of a relatively more more formable and more thermally conductive metal material such as aluminum or copper and is fitted over the opposite end of the insulating base to enclose the thermostat metal element and to enclose the first legs of the brackets. The cap is arranged to engage the reference surface on the opposite base end and portions of the cap are deformed into openings in the enclosed bracket legs so that the deformed cap portions pull the ends of the enclosed bracket legs firmly against the locating surfaces on the bosses on the base periphery and lock the cap to the base over the bracket legs. In that way, the cap precisely positions the thermostat metal element in the desired control location at the opposite end of the base where the element is adapted to move with snap action at precisely predetermined temperatures and so that such element movement is accurately transmitted to move the switch or other control means between desired control positions. The cap is formed of a material which has relatively high thermal conductivity so that the cap permits the thermal element to be thermally coupled in close heat-transfer relation through the cap to an object or zone whose temperature is to be monitored. The brackets are also adapted to be used to provide strong and secure mounting of the thermostat device on the object or in the zone. Both the brackets and the cap are characterized by relatively low component cost and are adopted for convenient and economical assembly with the base and with the thermostat metal element to precisely position the element in the desired control location on the base.

Finally, because the deformed portions of the cap pull the ends of the enclosed bracket legs firmly against the locating surfaces on the boss on the outer base periphery, the cap is firmly and reliably positioned relative to the noted reference and locating surfaces which face in opposite directions from each other. Accordingly, shrinkage and expansion of the insulating base during thermal cycling of the thermostat device does not tend to result in loosening of the cap so that reliable service life of the device is substantially increased.

DESCRIPTION OF THE DRAWINGS

Other objects, advantages, and details of the novel and improved thermally responsive control device of this invention appear in the following detailed description of preferred embodiments of the invention, the detailed description referring to the drawings in which.

DESCRIPTION OF THE PREFERRED EMBODIMENTS

Figure 1:
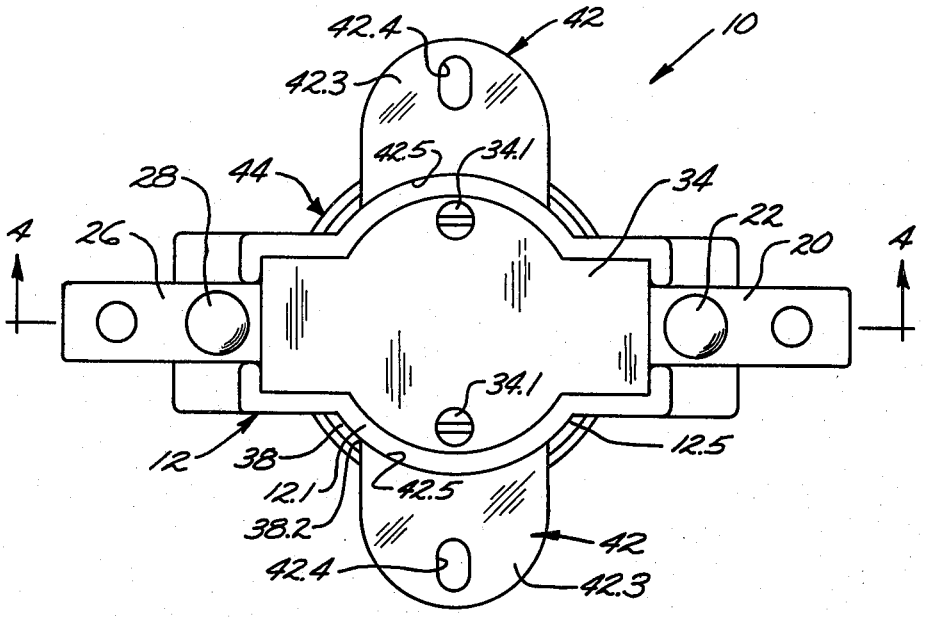
FIG. 1 is a plan view of the device provided by this invention.
Figure 2:
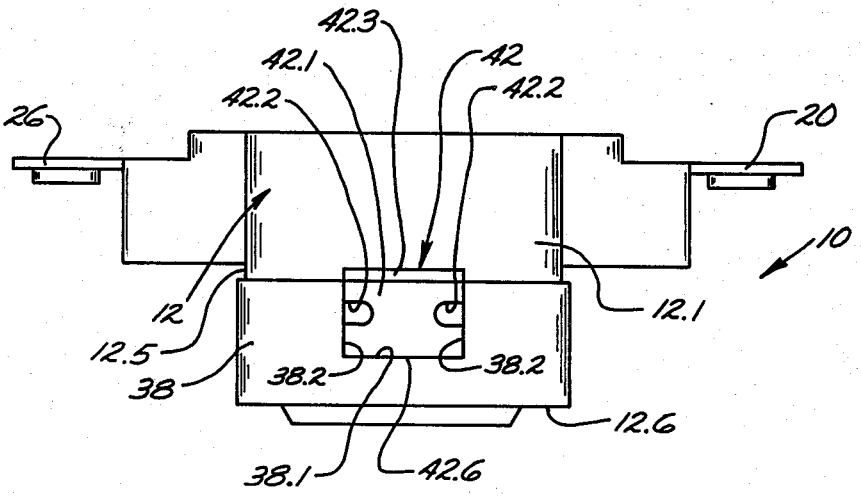
FIG. 2 is a front elevation view of the device of FIG. 1 with selected components of the device removed.

Referring to the drawings, 10 in FIGS. 1–5 indicates the novel and improved thermally responsive control device of this invention which is shown to include a base 12 preferably formed of a strong, rigid, electrical insulating material such as a phenolic material or the like. Electrical switch or other control means are mounted on the base for movement between first and second control positions. Preferably for example, the base 12 has a generally cylindrical base part 12.1 and has control means 14 mounted at one end 12.2 of that base part. That is, a movable electrical contact 16 is mounted at the distal end of a resiliently flexible, electrically conductive contact arm 18 while the opposite end of the arm is secured to a terminal 20 and to the base 12 by a rivet 22. The resilient arm 18 is biased to normally hold the contact 16 in engagement with the complementary or fixed contact 24 with a predetermined contact force in conventional manner. Preferably, the complementary contact 24 is mounted on a terminal 26 which is secured to the base 12 by a similar rivet 28. An adjusting means such as a screw 30 is arranged to be accessible from the opposite end 12.3 of the base and to be moved by threaded engagement with the base to bend the terminal 26, thereby to adjust the normal contact pressure between the contacts 16 and 24 to a selected level. However, the arm 18 is resiliently movable to permit disengagement of the contact 16 from the complementary contact 24 as will be understood. In that way, the switch means 14 is movable between the closed circuit control position shown in FIG. 3 electrically connecting the terminals 20 and 26 and an open circuit position in which the contacts 16 and 24 are spaced apart. A motion transfer pin 32 of a ceramic or other electrically insulating material or the like is axially slidable in an axial bore 12.4 in the base for moving the switch means between the noted control positions. Preferably, as shown in the drawings, the contacts 16 and 24 are located in a recess at the base end 12.2 so that an electrically insulating fiberboard cover 34 or the like is easily secured to the base by screws 34.1 for enclosing the electrical contacts in the device 10.

Figure 3:
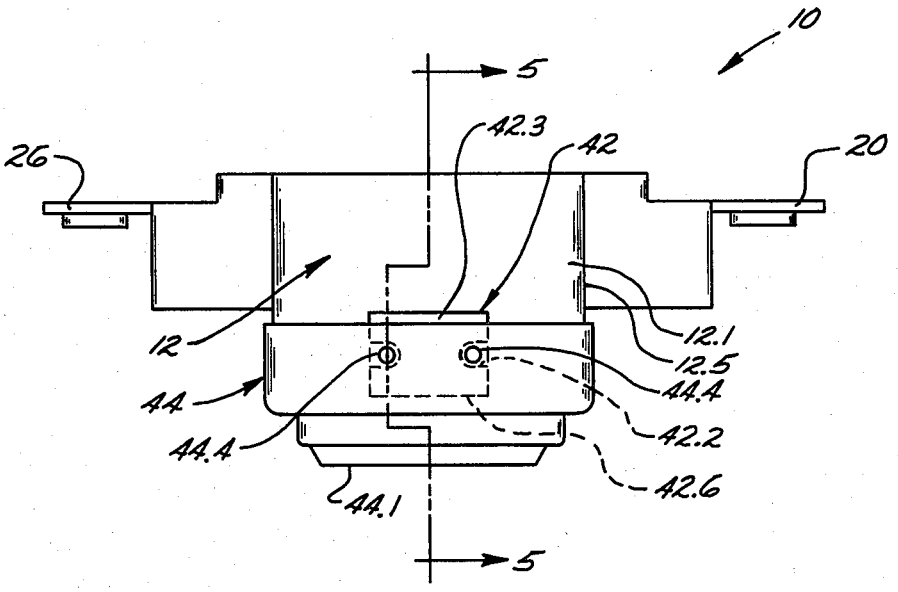
FIG. 3 is a front elevation view similar to FIG. 2 with said selected components in place.
Figure 4:
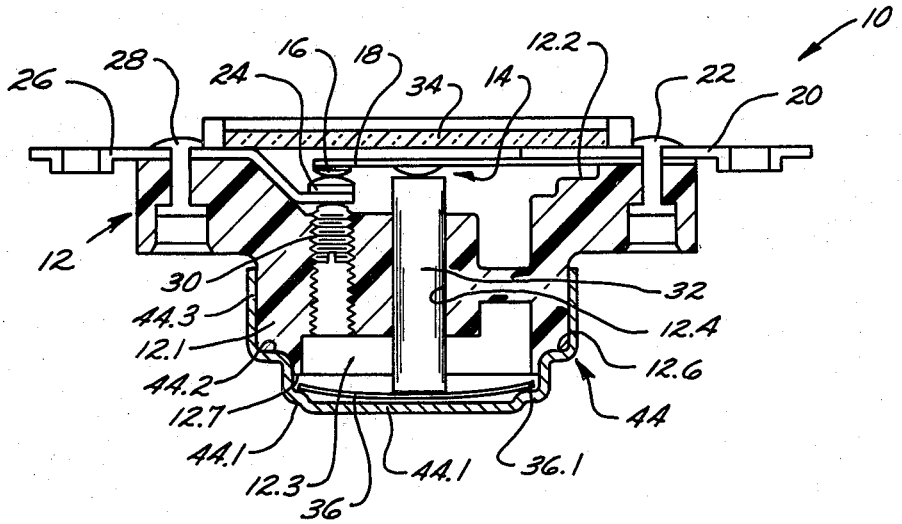
FIG. 4 is a section view along line 4—4 of FIG. 1.

The thermally responsive control device 10 further comprises a thermally responsive thermostat metal element 36 which is mounted in a control location at said opposite end 12.3 of the device base. The thermally responsive element is preferably of a conventional type embodying layers of metal of relatively high and low coefficients of thermal expansion which are bonded together to form a composite metal material which flexes in response to temperature change. (Only one layer is shown in FIG. 4 for convenience of illustration). The composite material is provided with a selected dished configuration so that the element is adapted to move with snap action between an original dished configuration as shown in FIG. 3 and an inverted dished configuration in response to the occurrence of selected changes in element temperature. The thermostat metal element is mounted in the noted control location on the base 12 so that the element is adapted to engage the motion transfer pin 32 to move the control means 14 between the noted control positions when the snap-acting element moves between its dished configurations in response to said temperature changes.

In accordance with this invention, boss means 38 are formed on the generally cylindrical base part 12.1 on the outer periphery 12.5 of the base adjacent to the opposite end 12.3 so that the locating surfaces 38.1 defined by the boss means face in a direction away from the opposite base end 12.3. Preferably, additional surfaces 38.2 of the boss means are also provided on the base periphery circumferentially spaced from the boss surface 38.1. In a preferred embodiment for example, the base 12 has a reference surface and a shoulder 12.6 and 12.7 respectively extending around the base end 12.3 and the boss means 38 extend generally around the circumference of the base end near that reference surface and shoulder. The boss surface 38.2 extend upwardly from the boss surface 38.1 at locations spaced from the locating surface around the base circumference. A pair of mounting brackets 42 are also provided, each bracket having a first leg 42.1 having one or more openings 42.2 therein. Each of the brackets also has a second leg 42.3 preferably having a mounting hole 42.4 therein. The first leg of each bracket is preferably provided with a generally curved, concave surface 42.5 and the bracket is mounted with that surface abutted against the periphery 12.5 of the base at a location between two boss surfaces 38.2 on the base. In that arrangement, the end 42.6 of each first leg abuts a respective locating surface 38.1 on the boss means and the second leg of each bracket extends outwardly from the base. In accordance with this invention, each of the brackets 42 is formed of a strong and rigid material such as plated or galvanized low carbon steel or the like.

Figure 5:
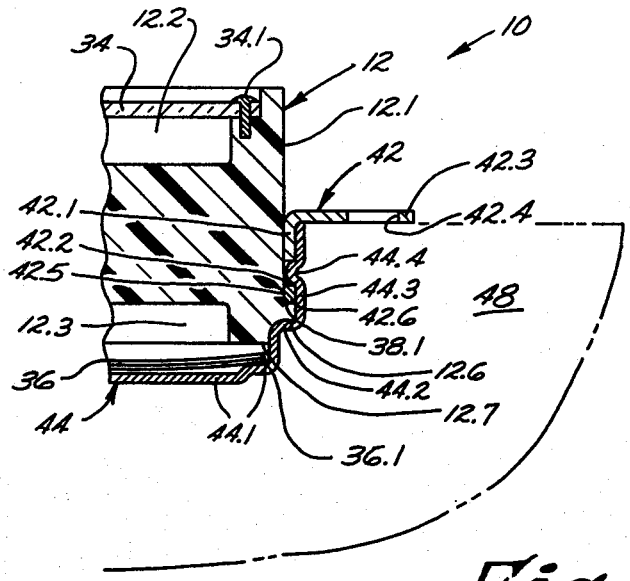
FIG. 5 is a partial section view to enlarged scale along line 5—5 of FIG. 3.

In accordance with this invention, a cap 44 is formed of a material such as copper or aluminum which is relatively much more formable than the material of the brackets 42 and which preferably has a much greater thermal conductivity than the material of the brackets. In the preferred embodiment of the invention, the cap 44 is initially provided in a form of a deep-drawn, generally cup-shaped member having a bottom 44.1 and having an inner locating shoulder 44.2 formed on a sleeve part 44.3 of the cap. The thermally conducting and highly formable cap is fitted over the generally cylindrical base part 12.1 at the opposite end 12.3 thereof so that the locating shoulder 44.2 of the cap engages the reference surface 12.6 on the base. In that way, the cap bottom 44.1 and the shoulder 12.7 receive the perimeter 36.1 of the snap acting thermostat metal element 36 with reasonably precise spacing therebetween. The cap is then provided with deformed or indented portions 44.4 which fit into openings 42.2 in the first legs of the mounting brackets as is best seen in FIGS. 3 and 5 so that they pull the brackets 42 down to firmly abut the ends 42.6 of the brackets with the locating surfaces 38.1 on the boss means. Such openings include slots formed in the margins of the bracket legs as shown or may include central holes or recesses or the like.

In that arrangement, the cap member 44 is easily provided with its desired initial deep-drawn cup shape. The cap is also easily positioned over the base end 12.3 to engage the reference surface 12.6. The formed portions 44.4 are easily provided in the highly formable cap material so that the cap serves to precisely locate the thermostat metal element 36 in the desired control location within the cap on the base 12. That is, the cap postions the snap-acting element 36 as shown in FIG. 3 when the element has the dished configuration corresponding to the control position of the control means 14 as illustrated in FIG. 3. However, the cap positions the element so that when the element temperature is changed and when the element tends to move its inverted dished configuration in response to such temperature change the perimeter 36.1 of the element bears against the cup bottom 44.1. Subsequent snap-acting movement of the disc to its inverted dished configuration them moves the motion transfer pin 32 to sharply move the control means 14 to its second control position as will be understood. Thereafter, as the thermostatic element is returned to its original temperature, the disc sharply returns to its original dished configuration. The provision of the deformed portions 44.4 in the cap also serves to securely mount the brackets 42 to the base 12. The formed portions 44.4 in the cap and the cylindrical configuration of the cap securely hold the brackets against the base 12. The lateral guide surfaces 38.2 of the boss means also serve to aid in retention of the brackets in the desired location relative to the base 12. Where the ends 42.6 of the bracket legs abut the locating surfaces 38.1 as shown, the cap and brackets cooperate to securely clamp the insulating base material between the oppositely facing base surfaces 12.6 and 38.1. Accordingly, shrinkage and expansion of the base material between those surfaces is small during thermal cycling of the device 10 so that loosening of the cap is avoided over a long service life. The brackets then serve to mount the device 10 on an object or apparatus indicated by the broken lines 46 in FIG. 5 so that the thermally conducting cap 44 is disposed in close heat-transfer relation to a zone 48 in the apparatus whose temperature is to be monitored using the device 10. The strong and rigid brackets 42 assure rugged and reliable mounting of the device 10 on the apparatus 46 without tending to cause any loosening of the cap 44 such as might change the thermal response characteristics of the device 10. The cap then achieves improved thermal conductivity between the thermostatic element 36 and the zone 48 to be monitored. In that way, the device 10 achieves both improved mounting and improved thermal performance. The simple and inexpensive forming of the cap 44 and its inexpensive mounting as above described also permits the device 10 to achieve low manufacturing cost and high reliability over a long service life.

It should be understood that although particular embodiments of this invention have been described above by way of illustrating the invention, other modifications of the described embodiments are possible within the scope of this invention. For example, control means other than switch means could be utilized within the scope of this invention. Various bracket configurations to be held in position by the formed cap 44 utilizing the various boss configurations on the base 12 are also within the scope of this invention. It should be understood that the invention includes all modifications and equivilance of the disclosed embodiments falling within the scope of the appended claims.

We claim:

1. A thermally responsive control device having control means mounted on base means for movement between first and second control positions, having a thermally responsive thermostat metal element mounted in a control location on the base means for movement between an original dished configuration of the element and an inverted dished configuration of the element in response to selected temperature changes to move the control means between said control positions when said temperature changes occur, and having means for mounting the device with the dished element in close heat-transfer relation to an object whose temperature is to be monitored, characterized in that, the base means has boss means formed thereon, mounting bracket means of a first relatively high strength metal material have openings formed therein and are positioned on the base means with said openings in a selected location relative to said boss means, the thermally responsive dished element is disposed in said control location on the base means, and cap means of a second relatively more formable metal material having selected thermal conductivity properties is fitted over the base means, the bracket means and the boss means and has portions thereof formed to fit into said openings in the bracket means to movably secure the thermally responsive dished element in said control location and to secure the mounting bracket means to the base means for use in mounting the device on the object whose temperature is to be monitored with the thermally responsive dished element disposed in close heat transfer relation to the object through the cap means.

2. A thermally responsive control device as set forth in claim 1 further characterized in that said second metal material embodied in said cap means has relatively greater thermal conductivity than the high strength metal material embodied in said bracket means.

3. A thermally responsive control device as set forth in claim 2 further characterized in that said mounting bracket means comprise a plurality of brackets each having a first leg with an opening therein fitted against the base means and having a second leg angularly extending from the first leg for use in mounting the device on the object whose temperature is to be monitored, and the cap means comprises a member having a sleeve part secured to the base means fitted over said first legs of each of the brackets, the sleeve part of the cap member having formed portions thereof fitting into said bracket openings for securing the brackets to the base means while also securing the thermally responsive metal element in said control location on the base means.

4. A thermally responsive control device as set forth in claim 3 wherein the base means are formed of electrical insulating material and have reference surface means on the base means facing outwardly from the control location on the base means, the boss means having locating surface means thereon, and ends of the first legs of the bracket means are abutted with said locating surface means, the formed portions of the sleeve part of the cap means holding said bracket leg ends firmly against the locating surface means so that the cap means are reliably positioned on the base means to maintain the thermostat metal element in said control location over a long service life.

5. A thermally responsive control device as set forth in claim 4 further characterized in that the reference locating surface means face in opposite directions from each other for reducing effects of base means expansion in loosening the cap means on the base means during thermal cycling of the device.

6. A thermally responsive control device as set forth in claim 3 further characterized in that the base means has a generally cylindrical portion, has said control means mounted at one end of said cylindrical base portion, has said thermally responsive dished element disposed at said control location at the opposite end of the cylindrical base portion, has motion transfer means axially slidable through the cylindrical base portion for moving the control means in response to movement of the thermally responsive dished element, and has said boss means located on the periphery of said cylindrical base portion at said opposite end thereof, in that said first legs of the bracket are disposed against the cylindrical base portion adjacent said opposite base end, and in that the cap means comprises a generally cup-shaped member having said sleeve part thereof fitted over said opposite base end, over said boss means, and over said first bracket legs and having said formed portions of said sleeve part surrounding the boss means and fitted into the openings in said first bracket legs for securing the brackets and the thermally responsive dished element to the base means.

7. A thermostat device comprising a base having a generally cylindrical portion of electrically insulating material, electrical switch means mounted on one end of the cylindrical base portion for movement between positions opening and closing an electrical circuit, a thermally responsive dished element formed of a thermostat metal material mounted on the base at the opposite end of the cylindrical base portion for movement with snap action between an original dished configuration and an inverted dished configuration in response to selected temperature changes, having reference surface on the base facing outwardly from said opposite base end, motion transfer means axially slidable in the cylindrical base portion between the dished thermostat metal element and the switch means for moving the switch means between said circuit positions when the thermostat metal element moves in response to said selected temperature changes, characterized in that, bosses are formed on the cylindrical base portion at locations around the periphery thereof at said opposite end of the base portion, the bosses having locating surfaces thereon facing in a direction opposite from said reference surface, a pair of brackets formed of a first relatively strong metal material each have a first leg with an opening therein disposed against the periphery of the cylindrical base portion at said opposite end so that ends of the first legs abut to locating surfaces on said bosses and have a second leg angularly extending from the cylindrical base portion for use in mounting the thermostat device on an object whose temperature is to be monitored, and a generally cup-shaped cap formed of a second relatively more formable metal material having relatively greater thermal conductivity than said first metal material has a sleeve part fitted over said opposite end of said cylindrical base portion, over said bosses, and over said first bracket legs to abut said reference surface, and portions of said sleeve part are formed to fit into the openings in the first bracket legs to draw ends of the first bracket legs firmly against said locating surfaces while holding the cap against the reference surface for securing the cap to the base to secure the brackets and the thermostat metal element to the base, whereby the brackets are positioned to permit the thermostat to be mounted on an object whose temperature is to be monitored with the dished thermostat metal element reliably disposed in close heat-transfer relation to the object through the thermally conductive cap.

* * * * *